US007631883B2

(12) United States Patent
Shen et al.

(10) Patent No.: US 7,631,883 B2
(45) Date of Patent: Dec. 15, 2009

(54) STRENGTHENED SLIDER AND METHOD OF MAKING THE SAME

(75) Inventors: Aifu Shen, Ningbo (CN); Scott Burke, Ningbo (CN)

(73) Assignee: WHAM-O, Inc., Emeryville, CA (US)

( * ) Notice: Subject to any disclaimer, the term of this patent is extended or adjusted under 35 U.S.C. 154(b) by 332 days.

(21) Appl. No.: 11/710,497

(22) Filed: Feb. 26, 2007

(65) Prior Publication Data

US 2007/0261156 A1 Nov. 15, 2007

(30) Foreign Application Priority Data

May 12, 2006 (CN) ..... 2006 2 0113932 U
Sep. 1, 2006 (CN) ..... 2006 1 0112336
Feb. 6, 2007 (CN) ..... 2007 1 0003414

(51) Int. Cl.
*B62B 15/00* (2006.01)

(52) U.S. Cl. ..... 280/18; 280/610; 441/74; 441/65

(58) Field of Classification Search ..... 280/18, 280/845, 610, 11.12, 8, 11.15, 11.14; 441/74, 441/65

See application file for complete search history.

(56) References Cited

U.S. PATENT DOCUMENTS 3,612,775 A * 10/1971 Miller ..... 360/234.6
4,412,687 A * 11/1983 Andre ..... 280/610
6,478,917 B1 * 11/2002 Magoni et al. ..... 156/245
7,029,349 B2 * 4/2006 Lin ..... 441/65
7,404,749 B2 * 7/2008 Cheung ..... 441/74
2008/0088099 A1 * 4/2008 Felix ..... 280/14.21

* cited by examiner

*Primary Examiner*—Jeffrey J Restifo
(74) *Attorney, Agent, or Firm*—The Nath Law Group; Jerald L. Meyer; Robert T. Burns

(57) ABSTRACT

The invention relates to a slider and a method of making the same. The slider comprises a bottom plate, an inner core, and a skin plate. The inner core has a bottom surface and a top surface, and is made of a foamed plastic. The bottom plate and the skin plate are bonded to the bottom surface and the top surface of the inner core, respectively, to form a laminate, and thus the inner core is sandwiched between the bottom plate and the skin plate. The bottom plate is a multi-layer structure, comprising a foamed plastic layer, an adhesive layer, a fabric layer, an ink layer, and a composite casting layer, which are laminated downward in order from the bottom surface of the inner core. The skin plate is also a multi-layer structure, comprising a foamed plastic layer, an adhesive layer, a film layer, a corona treatment layer and an ink layer, which are laminated upward in order from the top surface of the inner core. The invention provides a comfortable, lightweight and safely used slider, having the enhanced strength and toughness, with both a lower manufacturing cost and a simpler manufacturing process, whose design pattern is not apt to be worn off.

9 Claims, 3 Drawing Sheets

A-A

STRENGTHENED SLIDER AND METHOD OF MAKING THE SAME

RELATED APPLICATION

The application claims priority from the Chinese Patent application Nos. 2006101123362 filed on Sep. 1, 2006 and 2006101450595 filed on Nov. 11, 2006 as well as the Chinese Utility Model application No. 2006201139328 filed on May 12, 2006.

FIELD OF THE INVENTION

This invention relates to a slider used as a kind of sports goods and a method of making the same, and particularly to a foamed plastic slider with a printed pattern and a method of making the same.

BACKGROUND OF THE INVENTION

At present, a general slider is made of multi-layer solid hard plastic plates such as a skin plate, an inner core and a bottom plate by laminating, and a color design is printed on the outer surface of the slider. The slider made of a solid hard plastic isn't comfortable for the users, and isn't easily carried because it is heavy. Besides, the printed pattern is apt to be worn off in that the outer surface of its skin plate contacts frequently with the human body.

In view of the problems as described above, a kind of slider made of a foamed plastic has been proposed. Compared with the solid hard plastic, the foamed plastic is softer and lighter, therefore, increasing comfort and decreasing the weight of the slider. A transparent outer film is stuck on the surface of the slider, and a color design is printed on the inner surface of the outer film. However, using the outer film as the carrier of the color design increases manufacturing cost of the slider, and the manufacturing process of the slider also becomes more complicated. Meanwhile, since the whole slide is made of a foamed plastic, it makes the strength and toughness of the slider very poor, therefore the slider is apt to be spoiled when bumping on sharp objects, and it does harm the human body.

SUMMARY OF THE INVENTION

To solve the problems mentioned above, the invention is to provide a comfortable, lightweight and safely used slider, having enhanced strength and toughness, with both a lower manufacturing cost and a simpler manufacturing process, whose design pattern is not apt to be worn off, and to provide a method of making the same.

A slider according to the invention comprises a bottom plate, an inner core, and a skin plate, the inner core having a bottom surface and a top surface, and being made of a foamed plastic. The bottom plate and the skin plate are bonded to the bottom surface and the top surface of the inner core, respectively, to form a laminate, and thus the inner core is sandwiched between the bottom plate and the skin plate. The bottom plate is a multi-layer structure, comprising a foamed plastic layer of the bottom plate, an adhesive layer of the bottom plate, a fabric layer having a bottom surface and a top surface, an ink layer of the bottom plate, and a composite casting layer, which are laminated downward in order from the bottom surface of the inner core, the foamed plastic layer being bonded to the bottom surface of the inner core and the composite casting layer being the outmost layer of the bottom plate. The skin plate is also a multi-layer structure, comprising a foamed plastic layer of the skin plate, an adhesive layer of the skin plate, a film layer having a bottom surface and a top surface, a corona treatment layer having a bottom surface and a top surface, and an ink layer of the skin plate, which are laminated upward in order from the top surface of the inner core, the foamed plastic layer being bonded to the top surface of the inner core and the ink layer being the outmost layer of the skin plate.

This invention further provides a method of making the slider mentioned above, and the method comprises:

(1) the step of producing the bottom plate, comprising: printing the ink layer of the bottom plate directly on the bottom surface of the fabric layer of the bottom plate; bonding the top surface of the fabric layer to the foamed plastic layer of the bottom plate by an adhesive layer of the bottom plate; and bonding the composite casting layer directly to the ink layer of the bottom plate by casting; thereby finishing the production of the bottom plate;

(2) the step of producing the skin plate, comprising: performing a corona treatment on the top surface of the film layer to form the corona treatment layer; printing the ink layer of the skin plate directly on the top surface of the corona treatment layer; and bonding the bottom surface of the film layer to the foamed plastic layer of the skin plate by an adhesive layer of the skin plate, thereby finishing the production of the skin plate; and (3) the step of making the bottom plate, the inner core, and the skin plate bonded together by adhesive bonding to form a laminate, wherein the inner core is sandwiched between the bottom plate and the skin plate.

A merit of this invention is that the fabric layer is used in the bottom plate, which improves the strength and toughness of the slider. Thus, when the slider bumps on sharp metals and other objects, it prevents them from penetrating through the slider, therefore providing an effective protection to the human body.

In addition, a pattern is directly printed on the film layer in a slider of this invention, thereby omitting the necessity of using a transparent outer film, thus, on one hand, reducing the weight of the slider, and on the other hand, decreasing the manufacturing cost and simplifying the manufacturing process on the premise of fastening the color of the pattern on the slider effectively and preventing the pattern from wear and tear effectively.

Figure 1:
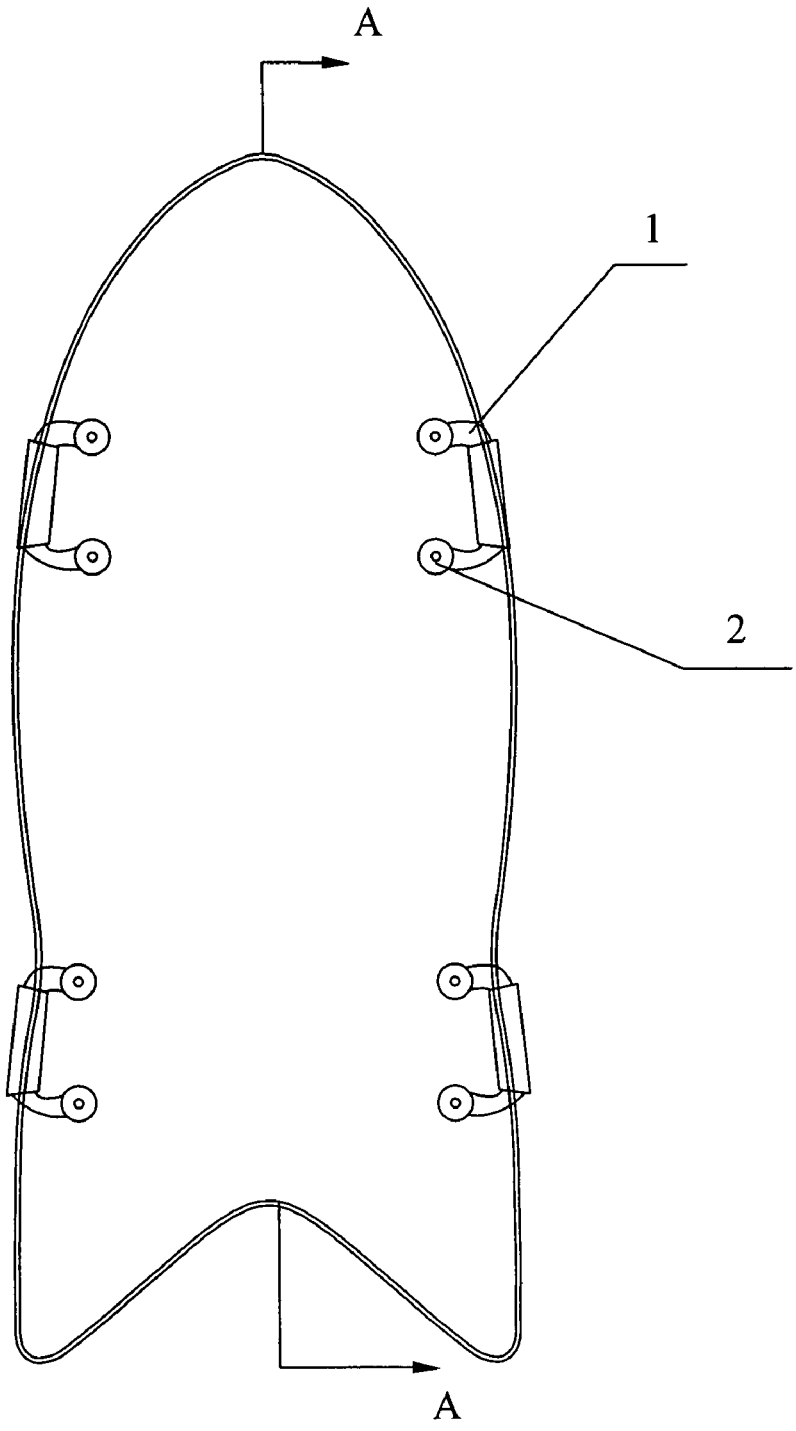
FIG. 1 is a top view of a slider of the present invention.

The reference numbers in the drawings are defined as follows:

1—slider handle; 2—handle-guiding and fixing element; 3—inner core; 4—guide; 5*a*—binder layer of the skin plate; 5*b*—binder layer of the bottom plate; 6*a*—foamed plastic layer of the skin plate; 6*b*—foamed plastic layer of the bottom plate; 7*a*—adhesive layer of the skin plate; 7*b*—adhesive layer of the bottom plate; 8—fabric layer; 9—ink layer of the bottom plate; 10—film layer; 11—corona treatment layer; 12—ink layer of the skin plate; 13—composite casting layer; 14—bottom plate; 15—skin plate.

DETAILED DESCRIPTION OF PREFERRED EMBODIMENTS

The particular embodiments of the present invention will be described below in connection with the drawings.

As shown in FIG. 1, several slider handles 1 are provided on the skin plate of the slider, thus facilitating one to hold it by hand when sliding the slider not to fall down from the slider, or facilitating one to carry it by hand when not sliding the slider. The slider handles 1 can be fixed on the slider by handle-guiding and fixing elements 2.

Figure 2:
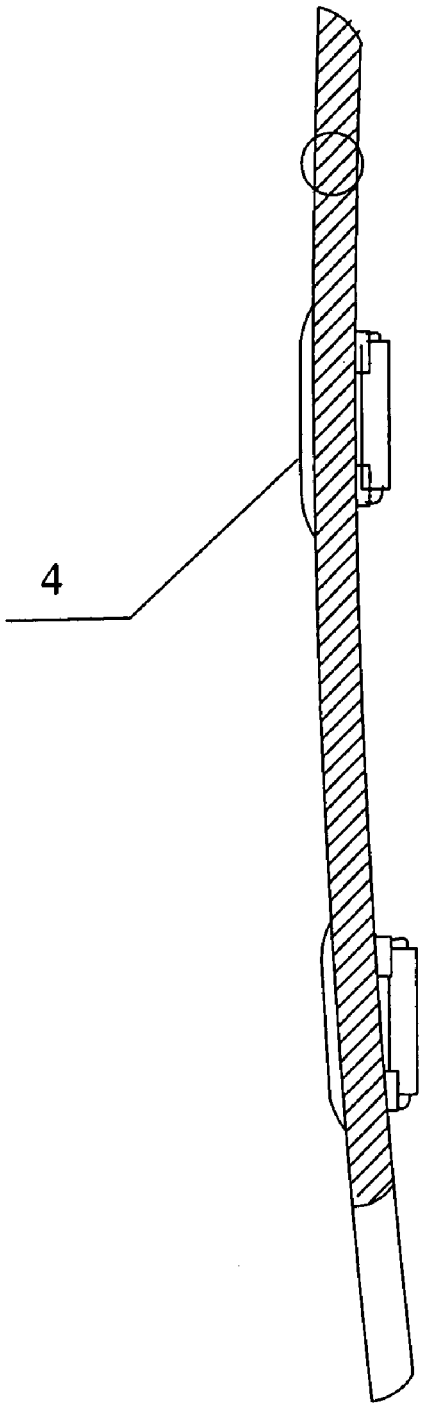
FIG. 2 is a cross sectional view taken along the A-A line of FIG. 1.

FIG. 2 is a cross sectional view taken along the A-A line of FIG. 1. The guides 4 are provided on the rear surface of the slider opposite to the slider handles 1, namely, on the bottom plate of the slider. In practical application, the slider handles 1 can be fixed on the slider with the guides 4 by handle-guiding and fixing elements 2.

Figure 3:
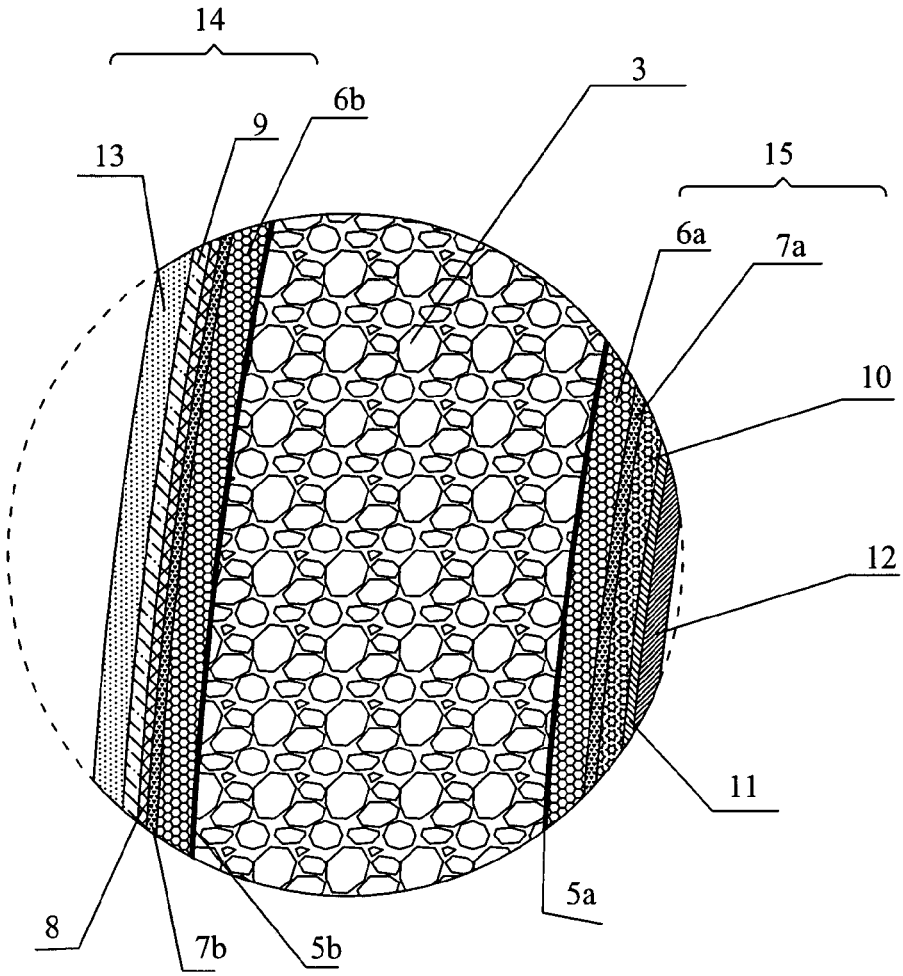
FIG. 3 is a partly enlarged view of FIG. 2.

FIG. 3 is a partly enlarged view of FIG. 2. The slider is made of multi-layer plastic plates, that is, an inner core 3, a bottom plate 14 and a skin plate 15. The inner core 3 has a bottom surface and a top surface. The inner core 3, the bottom plate 14 and the skin plate 15 are bonded together by laminating, and the bottom plate 14 and the skin plate 15 are bonded to the bottom surface and the top surface of the inner core 3, respectively, to form a laminate, wherein the inner core 3 is sandwiched between the bottom plate and the skin plate.

The inner core 3 of the slider can be made of a foamed plastic material, wherein the expandable polyethylene (EPE) foamed plastic and the expandable polystyrene (EPS) foamed plastic are preferred.

The bottom plate 14 comprises a foamed plastic layer 6*b*, an adhesive layer 7*b*, a fabric layer 8, an ink layer 9 of the bottom plate and a composite casting layer 13, which are laminated downward in order from the bottom surface of the inner core 3, the fabric layer 8 having a bottom surface and a top surface.

The ink layer 9 of the bottom plate is directly printed on the bottom surface of the fabric layer 8, the foamed plastic layer 6*b* of the bottom layer 14 is bonded to the top surface of the fabric layer 8 by the adhesive layer 7*b* of the bottom plate 14, and the composite casting layer 13 is bonded to the ink layer 9 with a printed pattern by casting.

In this embodiment, the fabric layer 8 can be a non-woven fabric or a woven fabric. There is no specific limit to the ink used in the ink layer 9. For example, a commonly used anti-UV (i.e., anti-ultra violet rays) ink can be used as the ink in the ink layer 9. The foamed plastic layer 6*b* of the bottom plate 14 can be made of a cross-linked polyethylene (X-PE) foamed plastic sheet with a thickness of 3 mm. The adhesive, which is used in the adhesive layer 7*b*, is not particularly limited, but those dry composite adhesives, which are commonly employed in the prior art, such as a PE adhesive, are typically used in this invention. The composite casting layer 13 can be made of a linear low density polyethylene (LLDPE) material such as LLDPE 480μ, and is coated on a plate surface by extruding. After the casting layer 13 is composited with the X-PE foamed plastic sheet, it is naturally matured for 24 hours to increase the compound fastness.

The skin plate 15 comprises a foamed plastic layer 6*a*, an adhesive layer 7*a*, a film layer 10, a corona treatment layer 11 and an ink layer 12, which are laminated upward in order from the top surface of the inner core 3, the film layer 10 having a bottom surface and a top surface, and the corona treatment layer 11 having a bottom surface and a top surface. A corona treatment is performed on the top surface of the film layer 10 to form the corona treatment layer 11, the ink layer 12 is printed on the corona treatment layer 11, and the foamed plastic layer 6*a* of the skin plate 15 is bonded to the bottom surface of the film layer 10 by the adhesive layer 7*a* of the skin plate 15. No films need to cover the top surface of the ink layer 12, thereby the top surface of the ink layer 12 being directly exposed to the outward air.

In this embodiment, the foamed plastic layer 6*a* of the skin plate 15 can be made of a X-PE foamed plastic sheet with a thickness of 3 mm. The adhesive, which is used in the adhesive layer 7*a*, is not particularly limited, and those dry composite adhesives, which are commonly employed in the prior art, such as a PE adhesive, can be used in the present invention. Although the material of the film layer 10 is not particularly limited, the film on which an ink can be printed is typically used. For example, the polyethylene film on which the ink can be printed is preferred. The thickness of the film layer is about 40 μm.

The formation process of the corona treatment layer 11 is as follows: treating the top surface of the film layer 10 with high frequency electric sparks of 12,000 V and 20,000 Hz, to form pits whose diameter is less than 0.1 mm being distributed on the top surface of the film layer 10. The corona treatment layer 11 is used to increase the adhesion to the ink layer.

A kind of inert ink is preferred to be used in the ink layer 12, because such ink has excellent anti-oxidation, wear-resistant, stain resistant and adhesive properties. Generally, the ink layer 12 has a thickness of about 0.03 mm. Additionally, in order to further increase the adhesion to the ink layer, the surface of the ink layer can also be treated with high frequency electric sparks to form a rough layer with many tiny concaves having a diameter of less than 0.1 mm being distributed on the rough layer.

The skin plate 15 and the bottom plate 14 are bonded to the inner core 3 via their respective binder layers 5*a* and 5*b*. The binder layer 5 is a binding adhesive of hot-melt glue, such as EVA hot-melt glue. A hot-melt recombination machine is used to bond the bottom plate 14 to the inner core 3, and to bond the skin plate 15 to the inner core 3.

In the practical production of the slider, the inner core 3, the bottom plate 14 and the skin plate 15 can be prepared firstly, and then the bottom plate 14 and the skin plate 15 are bonded to the bottom surface and the top surface of the inner core 3, respectively, to form a laminate. Finally, the slider handle 1 and/or the guide 4 can be installed according to the practical need.

What is claimed is:

1. A slider, comprising a bottom plate, an inner core, and a skin plate, the inner core having a bottom surface and a top surface, and being made of a foamed plastic, the bottom plate and the skin plate being bonded to the bottom surface and the top surface of the inner core, respectively, to form a laminate, and the inner core being sandwiched between the bottom plate and the skin plate, wherein the bottom plate is a multi-layer structure, comprising a foamed plastic layer, an adhesive layer, a fabric layer having a bottom surface and a top surface, an ink layer, and a composite casting layer, which are laminated downward in order from the bottom surface of the inner core, the foamed plastic layer being bonded to the bottom surface of the inner core and the composite casting layer being the outmost layer of the bottom plate; and the skin plate is a multi-layer structure, comprising a foamed plastic layer, an adhesive layer, a film layer having a bottom surface and a top surface, a corona treatment layer having a bottom surface and a top surface, and an ink layer, which are laminated upward in order from the top surface of the inner core, the foamed plastic layer being bonded to the top surface of the inner core and the ink layer being the outmost layer of the skin plate.

2. The slider of claim 1, wherein the fabric layer is a non-woven fabric and/or a woven fabric.

3. The slider of claim 1, wherein the ink layer of the bottom plate is directly printed on the bottom surface of the fabric layer.

4. The slider of claim 1, wherein the fabric layer is bonded to the foamed plastic layer of the bottom plate by an adhesive layer.

5. The slider of claim 1, wherein the corona treatment layer is obtained by treating the top surface of the film layer with high frequency electric sparks of 12,000 V and 20,000 Hz.

6. The slider of claim 5, wherein pits whose diameter is less than 0.1 mm are distributed on said corona treatment layer.

7. The slider of claim 1, wherein the ink layer of the skin plate is directly printed on the top surface of the corona treatment layer.

8. A method of making the slider of claim 1, comprising: (1) the step of producing the bottom plate, comprising: printing the ink layer directly on the bottom surface of the fabric layer of the bottom plate; bonding the top surface of the fabric layer to the foamed plastic layer of the bottom plate by an adhesive layer; and bonding the composite casting layer directly to the ink layer by casting; thereby finishing the production of the bottom plate; (2) the step of producing the skin plate, comprising: performing a corona treatment on the top surface of the film layer to form the corona treatment layer; printing the ink layer directly on the top surface of the corona treatment layer; and bonding the bottom surface of the film layer to the foamed plastic layer of skin plate by an adhesive layer, thereby finishing the production of the skin plate; and (3) the step of making the bottom plate, the inner core, and the skin plate bonded together by adhesive bonding to form a laminate, wherein the inner core is sandwiched between the bottom plate and the skin plate.

9. The method of claim 8, wherein the corona treatment layer is formed by treating the top surface of the film layer with high frequency electric sparks of 12,000 V and 20,000 Hz, thereby to form pits whose diameter is less than 0.1 mm being distributed on the top surface of the film layer.

* * * * *